US005715639A

United States Patent [19]

Yamada

[11] Patent Number: 5,715,639

[45] Date of Patent: Feb. 10, 1998

[54] METAL ROOF BOARD CONNECTING STRUCTURE

[75] Inventor: Yukio Yamada, Tokuyama, Japan

[73] Assignee: Yamada Co., Ltd., Yamaguchi-Ken, Japan

[21] Appl. No.: 523,944

[22] Filed: Sep. 6, 1995

[51] Int. Cl.[6] ..... E04D 1/18

[52] U.S. Cl. ..... 52/528; 52/469; 52/542

[58] Field of Search ..... 52/528, 529, 530, 52/531, 537, 538, 542, 545, 588.1, 459, 462, 465, 469

[56] References Cited

U.S. PATENT DOCUMENTS

| | | | |
|---|---|---|---|
| 11,292 | 7/1854 | Outcalt | 52/528 |
| 1,292,960 | 1/1919 | Owens | 52/528 |
| 2,159,136 | 5/1939 | Delk | 52/537 |
| 2,855,871 | 10/1958 | Huntington | 52/462 |
| 4,366,656 | 1/1983 | Simpson | 52/528 |
| 4,833,853 | 5/1989 | Deibele et al. | 52/462 |
| 5,187,911 | 2/1993 | Cotter | 52/528 |
| 5,363,624 | 11/1994 | Cotter | 52/528 |

FOREIGN PATENT DOCUMENTS 62-23140 5/1987 Japan .

*Primary Examiner*—Michael Safavi

*Attorney, Agent, or Firm*—John P. White

[57] ABSTRACT

A metal roof board connecting structure for connecting metal roof boards includes a raised-up flat lock seam portion formed by bending flatly and seamly raised-up regions of two metal roof boards which are arranged adjacently to each other, and a cap member capped on the raised-up flat lock seam portion. A part of the raised-up region of one of the two metal roof boards forms a first cap engaging projection and a bent portion of the raised-up flat lock seam portion forms a second cap engaging projection so as to be arranged in symmetrical with the first projection. The cap member has a two elastic side walls a center portion of each of which has an engaging recess and a lower end portion of each of which is extended downwardly and outwardly to extend away from each other. When the cap member is capped on the raised-up flat lock seam portion, the engaging recesses of the two side walls of the cap member are engaged with the first and second cap engaging projections of the one raised-up region and the raised-up flat lock seam portion of the two metal roof boards, and that engagement is semipermanently secured by the elastic force of the two side walls of the cap member.

2 Claims, 3 Drawing Sheets

METAL ROOF BOARD CONNECTING STRUCTURE

BACKGROUND OF THE INVENTION

1. Field of the Invention

This invention relates to a metal roof board connecting structure.

2. Description of the Related Art

Various metal roof board connecting structures are known to date. However, known metal roof board connecting structures have such problems that water proofing and anticorrosion are insufficient if the structures are designed simple in order to facilitate the connecting work of metal roof boards and, conversely, working cost is high and connecting work is complicated if the structures are designed to provide sufficient water proofing and anticorrosion.

For instance, in a metal roof board connecting structure disclosed in Jpn. Pat. Appln. KOKOKU Publication No. 62-23140, a long and narrow support member formed by an extruded metal and having a complicated cross section is fixed on a base roof board along the inclination of a roof. End portions of two metal roof boards arranged in both sides of the support member and extending along the both side surfaces of the support member are raised up and the raised-up end portions of the two metal roof boards are connected to the both side surfaces of the support member by capping a long and narrow cap extending along the support member on the support member with the raised-up end portions of the two metal roof boards being in contact with the both side surfaces of the support member.

SUMMARY OF THE INVENTION

The metal roof board connecting structure of Jpn. Pat. Appln. KOKOKU Publication No. 62-23140 makes the material cost of the structure be high. Additionally, the structure of the roof must be designed with taking the weight of the metal support members applied on the base roof board into consideration.

This invention is derived from the above described circumstances, and therefore the object of this invention is to provide a metal roof board connecting structure that is simple so that the connecting work of metal roof boards is easy and the working cost is low, and, further, can get sufficient water proofing and anticorrosion.

In order to achieve, the above described object of this invention, a metal roof board connecting structure of this invention comprises: two metal roof boards arranged adjacently relative to each other on a base roof board of a roof; raised-up regions arranged adjacently relative to each other in two metal roof boards, raised up from the base roof board of the roof, extending along the base roof board and having a raised-up flat lock seam portion which is formed by locking the raised-up regions flatly and seamly relative to each other; and a cap member capped on an end of the raised-up flat lock seam portion of the raised-up regions of the two metal roof boards. The raised-up flat lock seam portion has a first cap engaging projection which is formed by the raised-up flat lock seam portion on one of the raised-up regions of the two metal roof boards and projects from a surface of one of the raised-up regions, and the other raised-up region has a second cap engaging projection which projects from the other raised-up region in a direction opposite to the direction in which the first cap engaging projection projects. Further, the cap member includes a pair of side walls extending along the raised-up regions of the two metal roof boards, and the side walls have first and second engaging recesses to be engaged with the first and second cap engaging projections of the raised-up regions of the two roof boards and produce resilient force to hold the first and second cap engaging projections by the first and second engaging recesses. Extending end portions of the pair of side walls of the cap member corresponding to the base end portions of the raised-up regions of the two roof boards have outwardly extending portions extending away from each other and inwardly bent portions formed by bending outer extending ends of the outwardly extending portions toward directions in which the outer extending ends are approached to each other.

In the metal roof board connecting structure of this invention characterized by the construction as described above, the pair of adjacently arranged metal roof boards are connected with each other by locking flatly and seamly their raised-up regions which are arranged adjacent to each other and raised up from the base roof board of the roof, so that the connecting work of the two roof boards is easy. Additionally, since no structural member exists between the raised-up regions of the two metal roof boards in the flat lock seam portion, the structure of the flat lock seam portion is simple and its weight is light so that a load applied to the base roof board by the connecting structure is small.

The cap member capped on an end of the raised-up flat lock seam portion of the raised-up regions of the two metal roof boards sufficiently ensures water proofing and anticorrosion of the raised-up flat lock seam portion.

The first and second cap engaging projections formed as described above in the raised-up regions of the two metal roof boards have simple structure so that they can be manufactured in a simple manner. Additionally, the cap member including the pair of side walls having the first and second engaging recesses for covering and nipping the first and second cap engaging projections has also simple structure so that it can be manufactured in a simple manner.

Since the first and second engaging recesses of the pair of side walls of the cap member are fitted on the first and second cap engaging projections of the raised-up regions of the two roof boards, and nip the first and second cap engaging projections by using the resilient force generated from the pair of the side walls, the cap member is surely prevented from moving out of the raised-up flat lock seam portion so that the cap member can surely guarantee water proof and anticorrosion of the raised-up flat lock seam for a long period of time.

Since the extending end portions of the pair of side walls of the cap member include outwardly extending portions extending away from each other and inwardly bent portions formed by bending the outer extending ends of the outwardly extending portions toward directions in which the outer extending ends are approached to each other, the cap member can be easily put on and taken out from the raised-up flat lock seam portion of the raised-up regions of the two roof boards, and the extending end portions of the side walls of the cap member are prevented from being deformed by external force so that easy putting and taking out the cap member on and from the seam portion and anticorrosion of the extending ends are guaranteed for a long period of time.

In the metal roof board connecting structure described above, it is preferable that the raised-up region of one of the roof boards is formed by bending a portion of the one roof board neighboring the other roof board to stand upright from the remaining portion of the one roof board and then bending an upper half area of the standing upright portion of the one roof board toward the remaining portion of the one roof board before the raised-up flat lock seam portion is formed by the raised-up regions of the two roof boards; the raised-up region of the other roof board is formed by bending a portion of the other roof board neighboring the one roof board to stand upright from the remaining portion of the other roof board along the raised-up region of the one roof board so as to project beyond the raised-up region of the one roof board before the raised-up flat lock seam portion is formed by the raised-up regions of the two roof boards; the second cap engaging projection is formed by projecting one part of the raised-up region of the other roof board away from the raised-up region of the one roof board; and, when the raised-up flat lock seam portion is formed by the raised-up regions of the two roof boards, at first the outer end portion of the raised-up region of the other roof board extending beyond the raised-up region of the one roof board is bent over the outer end of the raised-up region of the one roof board in a direction extending away from the remaining portion of the raised-up region of the other roof board, then, the bent outer end portion of the raised-up region of the other roof board is bent to overlap the raised-up region of the one roof board, and further the outer end portion of the raised-up region of the one roof board on which the bent outer end portion of the raised-up region of the other roof board overlaps is bent toward an outer surface of the remaining portion of the raised-up region of the one roof board, the outer surface facing in a direction moving away from the remaining portion of the raised-up region of the other roof board, to sandwich the bent outer end portion of the raised-up region of the other roof board with the remaining portion of the raised-up region of the one roof board.

Since the raised-up flat lock seam portion is formed by bending the raised-up region which is formed by bending the one roof board, and by bending the raised-up region of the other roof board, with the extending end portion thereof being caught by the doubly bent portion of the raised-up region of the one roof board, to be overlapped with an outer surface of the doubly bent portion of the raised-up region of the one roof board, the raised-up flat lock seam portion formed as described above has a thickness equal to a total of a quadruple of the thickness of the one roof board and a triple of the thickness of the other roof board and, therefore, has a high rigidity without arranging an independent reinforcing member between the raised-up regions of the two roof boards.

In the metal roof board connecting structure of this invention characterized by a configuration as described above, it is further preferable that each of the first and second cap engaging projections, the first and second engaging recesses and the boundary areas between the outwardly extending portion and the inwardly bent portion of the extending end portion of each of the pair of side walls of the cap member is constituted by a curved wall.

With the above described arrangement, the risk of producing cracks in the two metal roof boards when the projections, the recesses and the boundary areas are formed. When cracks are produced in the metal boards, corrosion tends to be produced at cracks in the metal boards.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Now, various embodiments of the metal roof connecting structure of the present invention will be described with reference to the accompanying drawings.

[1st Embodiment]

Figure 1:
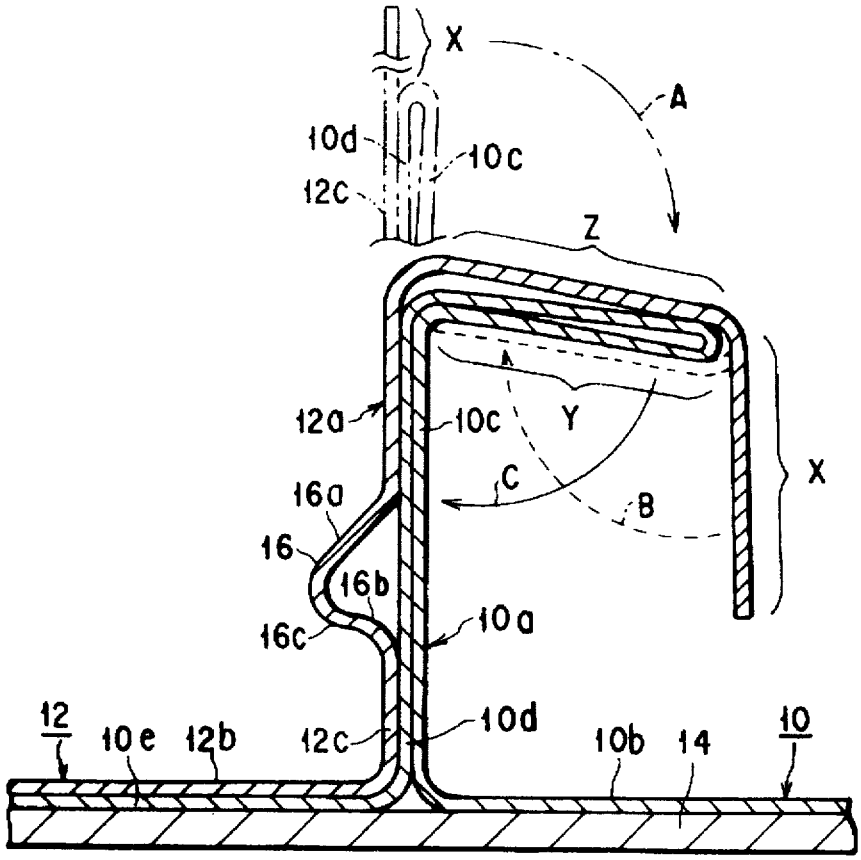
FIG. 1 is a cross sectional view schematically showing two adjacently arranged metal roof boards of a first embodiment of the metal roof board connecting structure of the invention, in a state while portions of the two metal roof boards arranged adjacent to each other are connected to each other by a raised-up flat lock seam.

In FIG. 1, two metal roof boards 10, 12 being applied with a first embodiment of the metal roof board connecting structure of this invention are placed on a base roof board 14 of a roof to be arranged adjacently to each other along a line perpendicular to the sloping direction of the roof.

The two roof boards 10, 12 have raised-up regions 10*a*, 12*a* arranged adjacent to each other and extending in the sloping direction of the roof with the raised-up regions 10*a*, 12*a* standing upright from the base roof board 14.

More specifically, the raised-up region 10*a* of the one metal roof board 10 is formed by bending substantially vertically a portion of the one roof board 10 neighboring the other roof board 12 to stand upright from the remaining portion (the bottom wall) 10*b* of the one roof board 10 to form an inner wall 10*c* and then bending an upper half area of the standing upright portion of the roof board 10 by 180° toward the bottom wall 10*b* to form an outer wall 10*d* along the inner wall 10*c*. In this embodiment, the lower end portion of the outer wall 10*d* is further bent by 90° from the surface of the outer wall 10*d* to be laid along the base roof board 14 and form a skirt portion 10*e*. Note that the two-dot chain line in FIG. 1 indicates an outer end portion of the inner wall 10*c* and the outer wall 10*d* that are bent by 180°.

An area of the other roof board 12 arranged adjacent to the one roof board 10 has a bottom wall 12*b* which is laid on the skirt portion 10*e* of the one roof board 10 and further has an outer wall 12*c* which is raised up from the bottom wall 12*b* to form a raised-up region 12*a* and extends along the outer wall 10*d* of the raised-up region 10*a* of the one roof board 10 to project beyond the raised-up region 10*a* of the one roof board 10. As indicated by two-dot chain line in FIG. 1, an outer end of the outer wall 12*c* projects beyond the boarder between the inner wall 10*c* and the outer wall 10*d*, where the raised-up region 10*a* of the one roof board 10 is bent by 180°.

A portion of the raised-up region 12*a* of the other roof board 12 located near the bottom wall 12*b* is projected away from the inner wall 10*d* of the raised-up region 10*a* of the one roof board 10 and forms a second cap engaging projection 16.

The cross section of the second cap engaging projection 16 is constructed by, as shown in FIG. 1, an upper wall 16*a* that is an inclined straight surface extending downward with it projecting away from the raised-up region 12*a* (or the outer wall 12*c*) of the other roof board 12, a bottom wall 16*b* that is located under the upper wall 16*a* and bent outward from the raised-up region 12*a* by about 90° so that it extends away from the raised-up region 12*a* toward the lower end of the upper wall 16*b*, and a corner portion 16*c* that connects the lower end of the upper wall 16*a* with the outer projecting end of the bottom wall 16*b*. With this arrangement, cracks would not be produced at the boundary between the raised-up region 12*a* (or the outer wall 12*c*) and the upper wall 16*a* of the second cap engaging projection 16, at that between the raised-up region 12*a* and the lower wall 16*b*, and at the corner portion 16*c* between the upper and lower walls 16*a* and 16*b*, when the part of the raised-up region 12*a* of the other roof board 12 is projected to form the second cap engaging projection 16, so that the boundaries and the corner portion 16*c* are prevented from being tend to be rusted.

Figure 2:
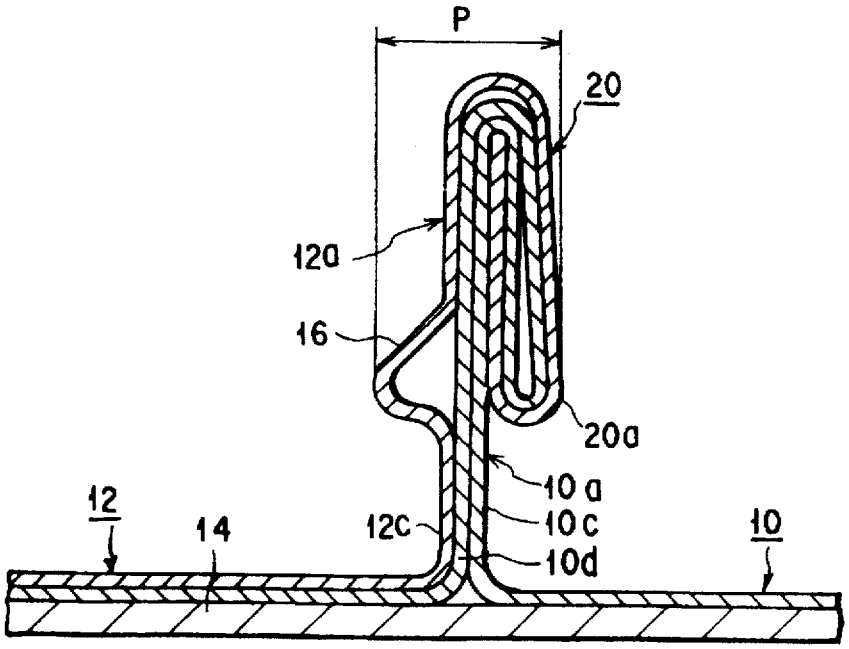
FIG. 2 is a cross sectional view schematically showing the adjacently arranged portions of the two metal roof boards of FIG. 1, in a state that the adjacently arranged portions have been connected by the raised-up flat lock seam.

Then, the raised-up regions 10*a* and 12*a* of the two roof boards 10 and 12 are connected to each other by a raised-up flat lock seam. For connecting the raised-up regions 10*a* and 12*a* of the two roof boards 10 and 12, at first, as indicated by arrows A and B in FIG. 1, the outer extending end portion (the upper half) X of the raised-up region 12*a* (or the outer wall 12*c*) of the other roof board 12 extending beyond the raised-up region 10*a* of the one roof board 10 is bent at the outer end of the raised-up region 10*a* (or the boundary between the inner wall 10*c* and the outer wall 10*d* at which the raised-up region 10*a* is bent by 180°) toward the outer wall 10*c* of the raised-up region 10*a* of the one roof board 10. Thereafter, a projecting end portion (an upper half) Y of the raised-up region 10*a* of the one roof board 10 is bent, as indicated by arrow C, toward the remaining portion (the lower half) of the outer wall 10*c* at the side opposite to the raised-up region 12*a* of the other roof board 12 with the bent outer extending end portion x of the raised-up region 12*a* of the other roof board 12 being held between the bent projecting end portion (the upper half) Y and the remaining portion (the lower half) of the outer wall 10*c*, to form a raised-up flat lock seam portion 20 as shown in FIG. 2.

Note that the raised-up flat lock seam portion 20 provides a first cap engaging projection 20*a* which projects from the inner wall 10*c* of the raised-up region 10*a* of the one roof board 10. As seen from FIG. 2, the second cap engaging projection 16 of the raised-up region 12*a* of the other roof board 12 projects in a direction opposite to the direction in which the first cap engaging projection 20*a* of the raised-up flat lock seam portion 20 projects.

Note that the raised-up region 10*a* of the one roof board 10 and the raised-up region 12*a* of the other roof board 12 including the second cap engaging projection 16 can be preformed before the one roof board 10 and the other roof board 12 are arranged on the base roof board 14.

In the preforming, the outer extending portion (the upper half) X of the raised-up region 12*a* (or the outer wall 12*c*) of the other roof board 12 projecting beyond the raised-up region 10*a* of the one roof board 10 may be bent by about 90° in a direction opposite to the direction in which the second cap engaging projection 16 projects.

With such preforming, the bent outer extending end portion (the bent upper half) X of the raised-up region 12*a* (or the outer wall 12*c* ) of the other roof board 12 projecting beyond the raised-up region 10*a* of the one roof board 10 is arranged on the projecting end of the raised-up region 10*a* of the one roof board 10 (or the boundary between the inner wall 10*c* and the outer wall 10*d* at which the raised-up region 10*a* is bent by 180°) to extend like an eaves when the bottom wall 12*b* of the other roof board 12 is laid on the skirt portion 10*e* of the one roof board 10 and further the outer wall 12*c* of the raised-up region 12*a* of the other roof board 12 is abutted on the inner wall 10*d* of the raised-up region 10*a* of the one roof board 10.

In the preforming, the projecting end portion (the upper half) Y of the raised-up region 10*a* of the one roof board 10 is bent by about 90° on the outer wall 10*c* side as shown in FIG. 1 and, at the same time, a portion Z of the raise-up region 12*a* (or the outer wall 12*c*) of the other roof board 12 that corresponds to the projecting end portion (the upper half) Y of the raised-up region 10*a* of the one roof board 10 bent about 90° as described above is also bent by 90° in a direction opposite to the direction in which the second cap engaging projection 16 is projecting. Additionally, the portion X of the raised-up region 12*a* of the other roof board 12 extending out from the 90° bent portion Z and projecting beyond the projecting end (or the boundary between the inner wall 10*c* and the outer wall 10*d* at which the raised-up region 10*a* is bent by 180°) of the 90° bent projecting end portion Y of the raised-up region 10*a* of the one roof board 10 may be further bent downward by about 90° as shown in FIG. 1.

In other words, the raised-up region 10*a* of the one roof board 10 may be bent to have an inverted L shape as shown in FIG. 1, while the raised-up region 12*a* of the other roof board 12 may be bent to have an inverted and squared U shape as also shown in FIG. 1, in the preforming.

With such preforming, when the bottom wall 12*b* of the other roof board 12 is laid on the skirt portion 10*e* of the one roof board 10 and further a base end portion of the raised-up region 12*a* of the other roof board 12 perpendicular to the bottom wall 12*b* is abutted on a corresponding base end portion of the inner wall 10*d* of the raised-up region 10*a* of the one roof board 10 perpendicular to the skirt portion 10*e* as shown in FIG. 2, the portion Z of the raised-up region 12*a* (or the outer wall 12*c*) of the other roof board 12 is placed on the 90° bent projecting end portion Y of the raised-up region 10*a* of the one roof board 10 and the outer extending end portion X of the raised-up region 12*a* (or the outer wall 12*c*) of the other roof board 12 is hung down from the projecting end of the 90° bent projecting end portion Y of the raised-up region 10*a* of the one roof board 10.

As seen from FIG. 2, since the raised-up flat lock seam portion 20 of this embodiment is constituted by the doubly folded outer and inner walls 10*c* and 10*d* of the raised-up region 10*a* of the one roof board and by the outer wall 12*c* of the raised-up region 12*a* of the other roof board 12 which has the projecting end portion held between the doubly folded outer and inner walls 10*c* and 10*d* of the raised-up region 10*a* of the one roof board 10 and surrounds the outer surface of the doubly folded outer and inner walls 10*c* and 10*d*, the raised-up flat lock seam portion 20 consequently has a thickness equal to a total of a quadruple of the thickness of the bottom wall 10*b* of the one roof board 10 and a triple of the thickness of the bottom wall 12*b* of the other roof board 12 and, therefore, has a high rigidity without arranging an independent reinforcing member between the raised-up region 10*a* of the one roof board 10 and the raised-up region 12*a* of the other roof board 12.

Figure 3:
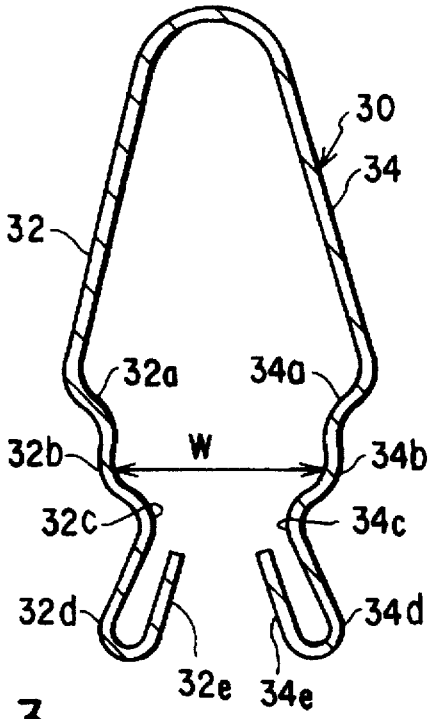
FIG. 3 is a schematic cross sectional view of a cap member, the cap member being used in the first embodiment of the metal roof board connecting structure to be capped on an outer end of the raised-up flat lock seam portion shown in FIG. 2.
Figure 4:
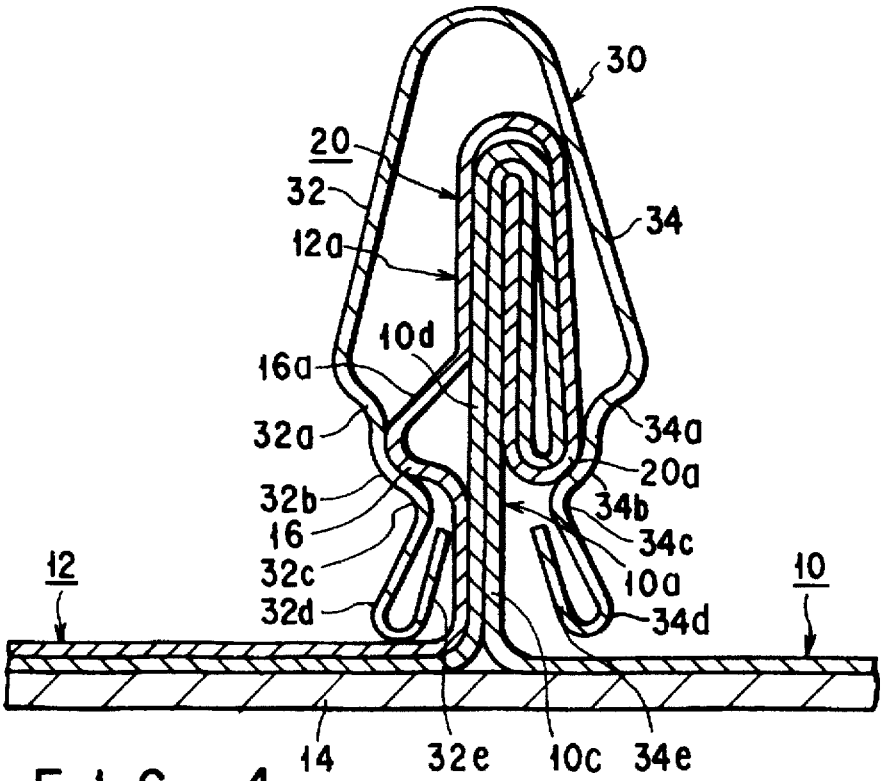
FIG. 4 is a cross sectional view schematically showing the cap member of FIG. 3 and the raised-up flat lock seam portion of the roof boards of FIG. 2 in a state that the cap member have been capped on the raised-up flat lock seam portion to complete the first embodiment.

FIG. 3 shows a cross section of a cap member 30 to be capped on the raised-up flat lock seam portion 20 in order to provide the raised-up flat lock seam portion 20 with water protection and anticorrosion. The cap member 30 is extended along the extending direction of the projecting end of the raised-up flat lock seam portion 20 (or along the slope of the roof).

The upper half of the cap member 30 has an inverted U-shaped cross section in which a pair of side walls 32, 34 extend along the raised-up regions 10*a*, 12*a* of the two roof boards 10, 12 and a curved wall which projects outwardly (upwardly in FIG. 3) connects the ends (upper ends in FIG. 3) of the side walls 32, 34. A distance between a center portion of the one side wall 32 at which the side wall 32 is divided into an upper half and a lower half, and a center portion of the other side wall 34 at which the side wall 34 is divided into an upper half and a lower half is so set that it is greater than a distance P (FIG. 2) between a top of the first cap engaging projection 20*a* formed by the raised-up flat lock seam portion 20 of the raised-up regions 10*a*, 12*a* of the two roof boards 10, 12 and a top of the second cap engaging projection 16 formed by the raised-up region 12*a* of the other roof board 12.

The lower half of the cap member 30 has a pair of first inwardly curved portions 32*a*, 34*a* extending downwardly and inwardly from the center portions of the side walls 32, 34 to approach each other, a pair of first outwardly curved portions 32*b*, 34*b* extending downwardly and outwardly from the lower ends of the first inwardly curved portions 32*a*, 34*a* to project away from each other, a pair of second inwardly curved portions 32*c*, 34*c* extending downwardly and inwardly from the lower ends of the first outwardly curved portions 32*b*, 34*b* to approach again in each other, a pair of outwardly extending portions 32*d*, 34*d* extending downwardly and outwardly from the lower ends of the second inwardly curved portions 32*c*, 34*c* to extend again away from each other, and a pair of inwardly bent portions 32*e*, 34*e* extending upwardly and inwardly from the lower ends of the outwardly extending portions 32*d*, 34*d* to approach each other.

The boundary portion between each of the outwardly extending portions 32*d*, 34*d* and the corresponding one of the inwardly bent portions 32*e*, 34*e* are curved by bending so as not to produce any cracks that tend to be rusted.

A distance between the pair of first outwardly curved portions 32*b*, 34*b* of the side walls 32, 34 in the lower half of the cap member 30 is so set that it is smaller than the distance P (FIG. 2) between the top of the first cap engaging projection 20*a* formed by the raised-up flat lock seam portion 20 of the raised-up regions 10*a*, 12*a* of the two roof boards 10, 12 and the top of the second cap engaging projection 16 formed by the raised-up region 12*a* of the other roof board 12.

When the cap member 30 having a configuration as described above is pushed downwardly with the inwardly bent portions 32*e*, 34*e* of the lower half of the pair of side walls 32, 34 being pressed against the outer surface of the projecting end of the raised-up flat lock seam portion 20, the inwardly bent portions 32*e*, 34*e* of the lower half of the cap member 30 are pushed aside by the outer surface of the projecting end of the raised-up flat lock seam portion 20 against the resilient force generated by the upper half of the pair of side walls 32, 34 of the cap member 30 and by the first inwardly curved portions 32*a*, 34*a* and the second inwardly curved portions 32*c*, 34*c* of the lower half of the cap member 30, so that the cap member 30 moves downward. Then, one of the inwardly bent portion 32*e* of the lower half of the cap member 30 located on the side of the second cap engaging projection 16 slides on the upper wall 16*a* of the second cap engaging projection 16 and is moved away from the other inwardly bent portion 34*e* against the resilient force described above.

The downward movement of the cap member 30 is stopped when the first outwardly curved portions 32*b*, 34*b* of the lower half of the cap member 30 are engaged with the first cap engaging projection 20*a* and the second cap engaging projection 16 formed by the raised-up regions 10*a*, 12*a* of the two roof boards 10, 12.

Under this condition, the first outwardly curved portions 32*b*, 34*b* of the lower half of the side walls 32, 34 of the cap member 30 form first and second engaging recesses for engaging with the first cap engaging projection 20*a* and the second cap engaging projection 16 formed by the raised-up regions 10*a*, 12*a* of the two roof boards 10, 12. The above engagement is semipermanently secured by the resilient force generated by the upper half of the pair of side walls 32, 34 of the cap member 30 and by the first inwardly curved portions 32*a*, 34*a* and the second inwardly curved portions 32*c*, 34*c* of the lower half of the side walls 32, 34 of the cap member 30.

Note that the resilient force generated by the first inwardly curved portions 32*a*, 34*a* and the second inwardly curved portions 32*c*, 34*c* of the lower half of the side walls 32, 34 of the cap member 30 is greater than that generated by the upper half of the pair of side walls 32, 34 of the cap member 30, and the former resilient force contributes greater to the semipermanet security of the above described engagement than the latter resilient force.

The resilient force generated by the upper half of the pair of side walls 32, 34 of the cap member 30 makes the inwardly bent portions 32*e*, 34*e* of the lower half of the cap member 30 to be pushed aside easily by the outer surface of the projecting end of the raised-up flat lock seam portion 20 when the cap member 30 is capped on the raised-up flat lock seam portion 20, so that the cap member 30 can be easily capped on the raised-up flat lock seam portion 20.

[2nd Embodiment]

Figure 5:
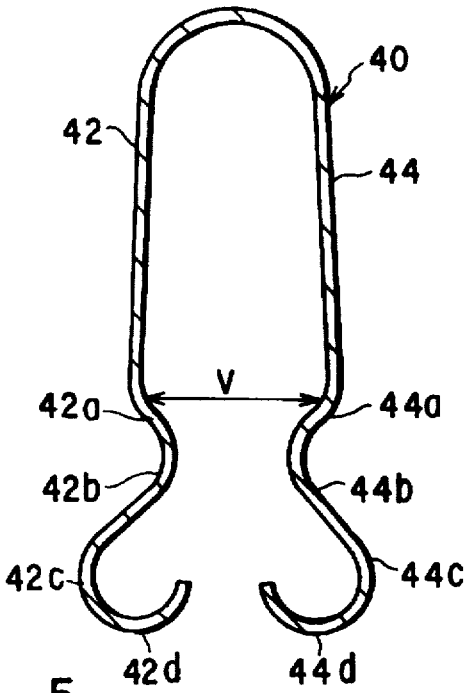
FIG. 5 is a schematic cross sectional view of a cap member, the cap member being used in a second embodiment of the metal roof board connecting structure to be capped on the outer end of the raised-up flat lock seam portions shown in FIG. 2.
Figure 6:
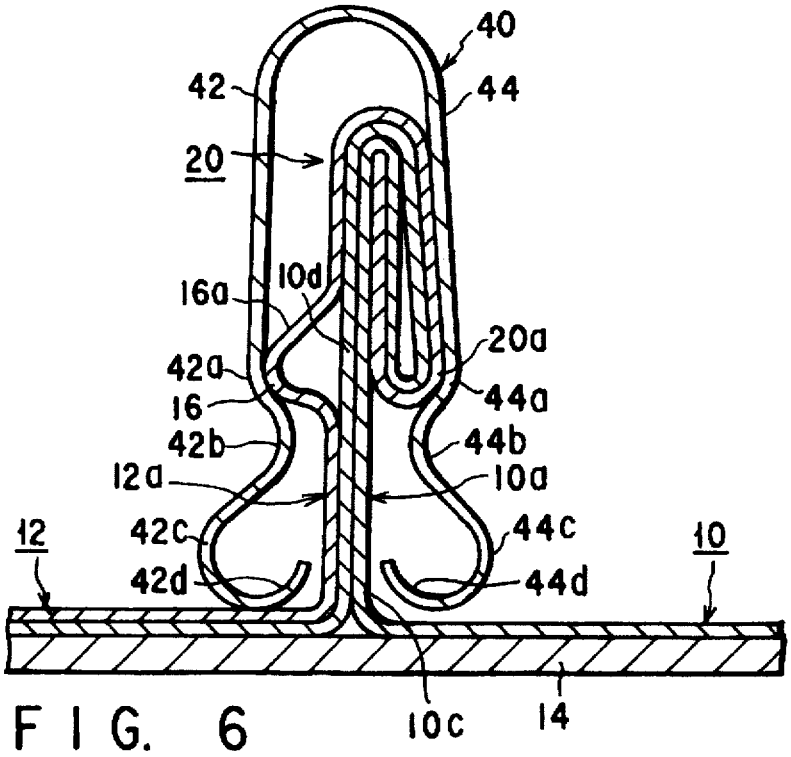
FIG. 6 is a schematic cross sectional view schematically showing the cap member of FIG. 5 and the raised-up flat lock seam portion of the two metal roof boards of FIG. 2 in a state that the cap member have been capped on the raised-up flat lock seam portion to complete the second embodiment.

FIG. 5 shows a cross section of a cap member 40, and the cap member 40 is used in a second embodiment of the metal roof board connecting structure according to this invention in place of the cap member 30 used in the above described first embodiment. FIG. 6 is a cross section of the cap member 40 of FIG. 5 and the raised-up flat lock seam portion 20 of the raised-up regions 10*a*, 12*a* of the two roof boards 10, 12 in a state that the cap member 40 is capped on the raised-up flat lock seam portion 20.

The cap member 40 of the second embodiment, like the cap member 30 of the first embodiment, extends along the extending direction of the projecting end of the raised-up flat lock seam portion 20 of the raised-up regions 10*a*, 12*a* of the two roof boards 10, 12 (or along the slope of the roof).

The upper half of the cap member 40 has an inverted U-shaped cross section in which a pair of side walls 42, 44 extend along the raised-up regions 10*a*, 12*a* of the two roof boards 10, 12 and a curved wall which projects outwardly (upwardly in FIG. 5) connects the ends (upper ends in FIG. 5) of the side walls 32, 34. A distance V between a center portion 42*a* of the one side wall 42 at which the side wall 42 is divided into an upper half and a lower half, and a center portion 44*a* of the other side wall 44 at which the side wall 44 is divided into an upper half and a lower half is so set that it is smaller than the distance P (FIG. 2) between the top of the first cap engaging projection 20*a* formed by the raised-up flat lock seam portion 20 of the raised-up regions 10*a*, 12*a* of the two roof boards 10, 12 and the top of the second cap engaging projection 16 formed by the raised-up region 12*a* of the other roof board 12.

The lower half of the cap member 40 has a pair of first inwardly curved portions 42*b*, 44*b* extending downwardly and inwardly from the center portions 42*a*, 44*a* of the side walls 42, 44 to approach each other, a pair of outwardly extending portions 42*c*, 44*c* extending downwardly and outwardly from the lower ends of the first inwardly curved portions 42*b*, 44*b* to project away from each other, and a pair of inwardly bent portions 43*d*, 44*d* extending upwardly and inwardly from the lower ends of the outwardly extending portions 42*c*, 44*c* to approach each other.

In this embodiment, the boundary portion between each of the outwardly extending portions 42*c*, 44*c* and the corresponding one of the inwardly bent portions 42*d*, 44*d* of the side walls 42, 44 is bent to have a curved wall which has a radius greater than that of the boundary portion between each of the outwardly extending portions 32*d*, 34*d* and the corresponding one of the inwardly bent portions 32*e*, 34*e* of the side walls 32, 34 of the cap member 30 of the first embodiment so as to completely eliminate the risk of producing cracks that may be subjected to be rusted.

When the cap member 40 having a configuration as described above is pushed onto the raised-up flat lock seam portion 20 with the inwardly bent portions 42*d*, 44*d* of the lower half of the pair of side walls 42, 44 being pressed against the outer surface of the projecting end of the raised-up flat lock seam portion 20, the inwardly bent portions 42*d*, 44*d* of the lower half of the cap member 40 are pushed aside by the outer surface of the projecting end of the raised-up flat lock seam portion 20 against the resilient force generated by the upper half of the pair of side walls 42, 44 of the cap member 40 and by the first inwardly curved portions 42*b*, 44*b* and the inwardly extending portions 42*d*, 44*d* of the lower half of the side walls 42, 44 of the cap member 40, and the cap member 40 moves downward. Then, the inwardly bent portion 42*d* of the lower half of the cap member 40 located on the side of the second cap engaging projection 16 slides on the upper wall 16*a* of the second cap engaging projection 16 and is moved away from the other inwardly bent portion 44*d* against the above described resilient force.

The downward movement of the cap member 40 is stopped when the center portions 42*a*, 44*a* of the pair of side walls 42, 44 of the cap member 40 are engaged with the first cap engaging projection 20*a* and the second cap engaging projection 16 formed by the raised-up regions 10*a*, 12*a* of the two roof boards 10, 12.

Under this condition, the center portions 42*a*, 44*a* of the pair of side walls 42, 44 of the cap member 40 form first and second engaging recesses for engaging with the first cap engaging projection 20*a* and the second cap engaging projection 16 formed by the raised-up regions 10*a*, 12*a* of the roof boards 10, 12. The above engagement is semipermanently secured by the resilient force generated by the upper half of the pair of side walls 42, 44 of the cap member 40 and by the first inwardly curved portions 42*a*, 44*a* of the lower half of the pair of side walls 42, 44 of the cap member 40.

Note that the resilient force generated by the first inwardly curved portions 42*b*, 44*b* of the lower half of the pair of side walls 42, 44 of the cap member 40 is greater than that generated by the upper half of the pair of side walls 42, 44 of the cap member 40, and the former resilient force contributes greater to the semipermanent security of the above described engagement than the later resilient force.

The resilient force generated by the upper half of the pair of side walls 42, 44 of the cap member 40 makes the inwardly bent portions 42*d*, 44*d* of the lower half of the cap member 40 to be pushed aside easily by the outer surface of the projecting end of the raised-up flat lock seam portion 20 when the cap member 40 is capped on the raised-up flat lock seam portion 20, so that the cap member 40 can be easily capped on the raised-up flat lock seam portion 20.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A metal roof board connecting structure for connecting metal roof boards on a base roof board of a roof, comprising:

two metal roof boards arranged adjacently relative to each other on the base roof board of the roof;

raised-up regions arranged adjacently relative to each other in the two metal roof boards, having base end portions raised up from the base roof board of the roof, extending along the base roof board and having a raised-up flat lock seam portion which, is formed by locking portions of the raised-up regions located further away from the base roof board than the base end portions, flatly and seamly relative to each other; and a cap member capped on an end of the raised-up flat lock seam portion of the raised-up regions of the two metal roof boards;

wherein the raised-up flat lock seam portion has a first cap engaging protection which is formed by the raised-up flat lock seam portion on one of the raised-up regions of the two metal roof boards and projects from a surface of one of the raised-up regions, the other raised-up region has a second cap engaging protection which protects from the other raised-up region in a direction opposite to the direction in which the first cap engaging protection projects, the cap member includes a pair of side walls extending along the raised-up regions of the two metal roof boards, and the side wall have first and second engaging recesses to be engaged with the first and second cap engaging protections of the raised-up regions of the two roof boards and produce resilient force to hold the first and second cap engaging projections by the first and second engaging recesses, and extending end portions of the pair of side walls of the cap member corresponding to the base end portions of the raised-up regions of the two roof boards have outwardly extending portions extending away from each other and inwardly bent portions formed by bending outer extending ends of the outwardly extending portions toward directions in which the outer extending ends are approached to each other; and, wherein the raised-up region of one of the roof boards is formed by bending a portion of the one roof board neighboring the other roof board to stand upright from the remaining portion of the one roof board and then bending an upper half area of the standing upright portion of the one roof board toward the remaining portion of the one roof board before the raised-up flat lock seam portion is formed by the raised-up regions of the two roof boards;

the raised-up region of the other roof board is formed by bending a portion of the other roof board neighboring the one roof board to stand upright from the remaining portion of the other roof board along the raised-up region of the one roof board so as to project beyond the raised-up region of the one roof board before the raised-up flat lock seam portion is formed by the raised-up regions of the two roof boards;

the second cap engaging projection is formed by projecting one part of the raised-up region of the other roof board away from the raised-up region of the one roof board; and when the raised-up flat lock seam portion is formed by the raised-up regions of the two roof boards, at first the outer end portion of the raised-up region of the other roof board extending beyond the raised-up region of the one roof board is bent over the outer end of the raised-up region of the one roof board in a direction extending away from the remaining portion of the raised-up region of the other roof board, then the bent outer end portion of the raised-up region of the other roof board is bent to overlap the raised-up region of the one roof board, and further the outer end portion of the raised-up region of the one roof board on which the bent outer end portion of the raised-up region of the other roof board overlaps is bent, toward an outer surface of the remaining portion of the raised-up region of the one roof board, the outer surface facing in a direction moving away from the remaining portion of the raised-up region of the other roof board, to sandwich the bent outer end portion of the raised-up region of the other roof board with the remaining portion of the raised-up region of the one roof board.

2. A metal roof board connecting structure according to claim 1, wherein each of the first and second cap engaging projections, the first and second engaging recesses and the boundary areas between the outwardly extending portion and the inwardly bent portion of the extending end portion of each of the pair of side walls of the cap member is constituted by a curved wall.

* * * * *